United States Patent [19]

Knight

[11] 4,290,057

[45] Sep. 15, 1981

[54] SEQUENTIAL POWER DISTRIBUTION CIRCUIT

[76] Inventor: Webster B. Knight, 2320 Abbey Dr., Apt. #6, Fort Wayne, Ind. 46815

[21] Appl. No.: 945,463

[22] Filed: Sep. 25, 1978

[51] Int. Cl.[3] ..... G08B 17/10

[52] U.S. Cl. ..... 340/539; 340/310 R; 340/538; 340/635; 340/693; 307/116; 307/23

[58] Field of Search ..... 340/539, 538, 531, 533, 340/310 R, 310 A, 310 CP, 663, 635, 636, 652, 657, 660, 692, 693; 307/116, 23, 66

[56] References Cited

U.S. PATENT DOCUMENTS

| | | | |
|---|---|---|---|
| 3,594,751 | 7/1971 | Ogden | 340/636 |
| 4,093,943 | 6/1978 | Knight | 340/693 |
| 4,138,670 | 2/1979 | Schneider et al. | 340/693 |

*Primary Examiner*—John W. Caldwell, Sr.
*Assistant Examiner*—Donnie L. Crosland
*Attorney, Agent, or Firm*—Richard T. Seeger

[57] ABSTRACT

A primary load, such as a conventional household light bulb, is series connected to a power source. The conventional light switch is replaced by a series connected circuit to the source and lamp. The circuit has an energy storage capacitor and a diode. A secondary load, such as an alarm, is coupled across the capacitor through an SCR (Silicon Controlled Rectifier). A sensing circuit, such as a smoke detector, is also connected across the capacitor and triggers the SCR upon detection of an alarm condition. A timing circuit is coupled between the SCR output and the diode to intermittently control the light bulb operation at a predetermined frequency upon smoke detection or other alarm. A switch selectively places in the circuit a neon night light or dimmer circuit for the primary load. In an alternative circuit the primary load is operated at near full power during periods of non-alarm. In a further circuit the power source and primary load are coupled to actuate an alarm when either the power source or the primary load become inoperative. Additionally, in a circuit having a power source which is unidirectional, or DC, the sensor alarm features are incorporated and additionally an alarm is actuated when the primary load becomes inoperative.

17 Claims, 8 Drawing Figures

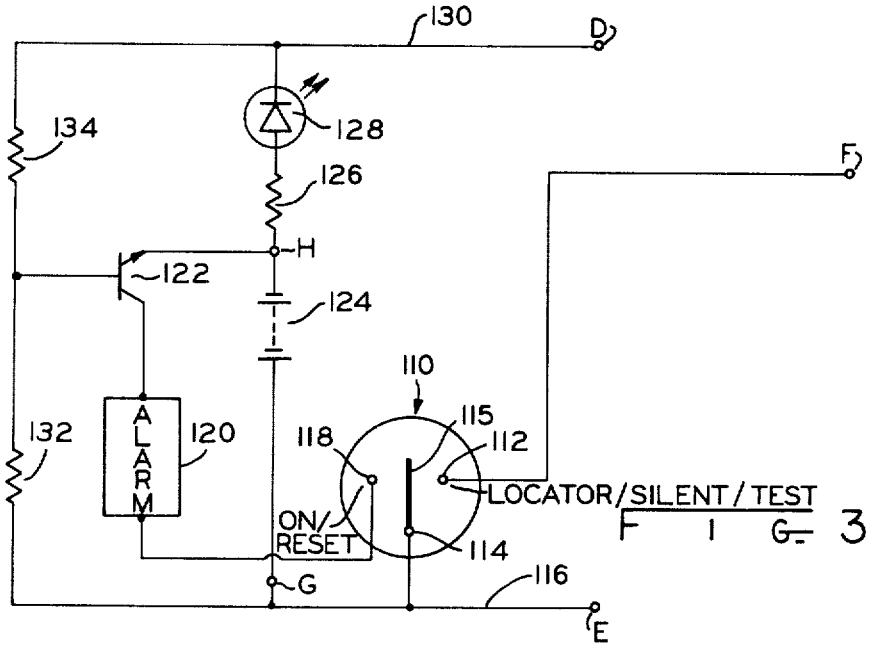
FIG. 3
FIG. 4
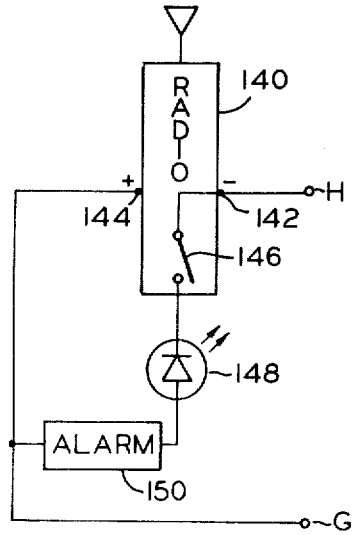
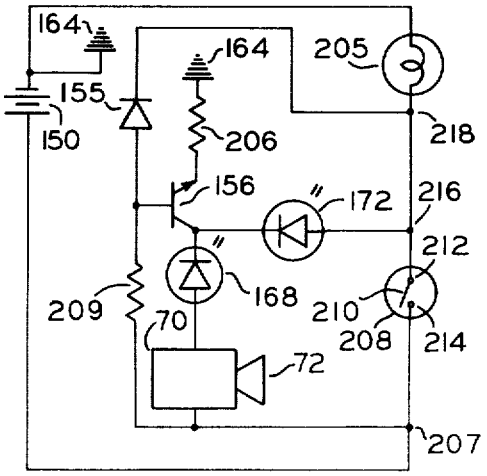
FIG. 7

SEQUENTIAL POWER DISTRIBUTION CIRCUIT

RELATED PATENT

Applicant herein is patentee in U.S. Pat. No. 4,093,943 entitled Sequential Power Distribution Circuit.

BACKGROUND OF THE INVENTION

1. Field of the Invention

This invention is in the field power distribution circuits and more particularly circuits which are adaptable to existing circuits for sensing and warning applications.

2. Description of Prior Art

Numerous systems have been designed for providing power for a secondary load, which typically may be an alarm system for smoke, heat, fire, or intrusion detection, as well as other detection functions and automatic correction functions, but these previous systems largely required their own power systems. In addition, active sensor systems having a constant power application to provide a more reliable and instantaneous operation are advantageous but due to the additional complexity and increased power consumption have been limited in their use. Further, alarm systems are preferably audio-visual and as such have required separate audio alarm means, such as a speaker and speaker drive circuit, and a separately wired and actuated light source, and generally relatively large power supplies, limiting the use of such alarm systems due to the expense of extensive installation and equipment cost. The need has existed for a compact power distribution system which takes full advantage of existing power wiring, existing components for the alarm, and provides an active sensor system, all at a minimum of installation cost, component cost, and power consumption cost. This invention fills this need to an extent not heretofore possible.

SUMMARY OF THE INVENTION

A primary load, such as a household lighting fixture, is coupled to a conventional household AC power source through the usual wall switch terminals. In one embodiment, the conventional switch is removed and in its place is a circuit which may have a first module having componentry, having all of the high voltage components, and is easily placeable in the switch box. A second module, including the sensor circuit, may be pluggable through the switch plate to the first module. This second circuit has an energy reserve device, such as a capacitor, and a diode which acts as a protective and an energy reserve retention component, and has only low voltage and low current used therein. Alternatively, the circuit may be in one module placed on the switch terminal box with the sensors being located advantageously in sensor detection areas. Also, a circuit is provided so that whether the household power source is AC (alternating current) or DC (direct current), an energy reserve charge is maintained on the capacitor. In a DC system, the capacitor may be eliminated. Placed across the capacitor is a second protective diode, and a sensor logic circuit which is adapted to receive a signal from externally placed sensors for smoke, fire, heat, intrusion, or the like. The logic circuit has an output connected to the gate of a silicon controlled rectifier which is placed across the capacitor in a circuit having leads adapted for attachment to a secondary load such as an audible alarm or automatic signaling device. Upon receiving a trigger signal from the sensor logic circuit, the SCR is caused to conduct and receives power alternately from the household power source and the energy reserve on the capacitor to maintain conduction once triggered. A reset switch is shunt mounted across the SCR and a momentary closing of the switch will reset or turn off the SCR, provided that the sensor logic circuit is no longer receiving an alarm condition signal from its sensors. Also, closing of the reset switch simulates an alarm condition for alarm circuit testing.

The SCR output is coupled through a timing logic circuitry which intermittently closes, at an adjustable period, a relay switch controlling the primary load or household lamp thus providing the lamp with intermittent full power source voltage to provide a visual alarm signal. The relay switch is coupled to the gate of a triac which is connected to the wall switch terminals so that the household lamp will be flashed during time of alarm. Further, with additional diode capacitances coupled between the cathode of the first diode and the triac gate, a dimmer circuit for the household lamp is provided. Thus, a conventional household lamp is operated at a power level less than its rated level during normal usage greatly prolonging its life. When an alarm condition exists, the dimmer circuitry is bypassed and the lamp is then flashed at full power rating making the warning signal more noticeable.

A circuit is coupled across the energy reserve having a rechargeable DC battery. A transistor has an emitter connected to one terminal of the battery and a collector coupled through an alarm system and a switch having first and second positions to the other terminal of the battery. The base of a transistor is connected through a voltage divider in the power source and primary load circuit and is biased "off" when both the power source and primary load are operative but is biased "on" when either the primary load or power source is inoperative. When the transistor is "on", or conducts, and the switch is in the first position, the alarm, which is preferably an audible alarm, is actuated alerting the occupants that the primary load or power source has failed and that repair or replacement is necessary before the sensor alarm circuit can be operative. The switch has a second position for bypassing the sensor alarm circuit and simulating an alarm condition for testing the power source and primary load, causing the primary load to flash at its full power level and at full brilliance.

A radio may be coupled into the circuitry and tuned to an emergency station for broadcasting weather alerts or emergency signals and when such signals are received, automatically closes a switch to the alarm circuit, alerting the occupants that an emergency message was being broadcast so that the occupants could then tune to the emergency frequency to become informed of the emergency condition.

Circuitry is also provided for use with unidirectional power sources such as DC batteries, automotive power supplies, or other DC applications which provides an alarm for sensed conditions such as smoke, heat, or intrusion, and also provides an alarm during the primary load failure. In the DC applications a transistor switch is normally biased to an "off" condition but on load failure, the bias changes to an "on" condition sounding an audible alarm and energizing a light emitting diode. A manually operable switch couples the DC power source to the primary load in a first position, during which the sensor circuit is inoperative, and decouples the primary load from the power source in a second position, during which the sensor circuit is operative.

An embodiment is provided having an AC power source and a primary load which may be a fluorescent lamp. Circuitry is provided so that during operation of the lamp any desired percentage or ratio of the power from each half cycle of the power source may be applied to operate the lamp in its normal or sensor application.

This invention has many applications where power distribution for operating any one of a plurality of secondary loads are required wherein minimized power consumption, componental requirements and installation cost in a system using existing power, terminals and housings are desirable. The primary, existing, power source is used to full advantage as are the primary existing loads coupled in that power source. During an alarm condition, full primary supply voltage is applied sequentially to the primary and/or secondary loads, with a secondary energy reserve and sensing components being supplied during alternate sequential primary voltage periods. This invention can be used in parallel or series circuits; can be used in either AC or DC circuits; can apply full primary source voltage to a primary load in one period and operates one or more secondary loads, including sensor logic systems sensitive to smoke, heat, light, radio, sound, and other energy signals; has low power consumption; minimized additional wiring and terminal requirements; is adaptable to battery operation and for connection to a battery charger circuit; is usable with any existing switch using in common the existing terminals, wiring, and switch housings; and minimizes the installation, equipment, and power requirements.

Therefore, it is an object of this invention to provide a power distribution circuit which is capable of using existing terminals, wiring, and housings and operates from the existing power supplies.

A further object of this invention is to provide connections to sensing and alarm systems using the circuitry of the foregoing object.

Another object of this invention is to provide additional non-alarm functions with the addition of minimum circuitry and installation requirements.

A further object of this invention is to provide in the circuits of the previous objects an alarm for indicating failure of either the power source or primary load in the circuit.

An additional object of this invention is to provide an automatic alarm when emergency conditions are broadcast on standard radio wave frequencies.

Another object of this invention is to provide an alarm load failure circuit with a unidirectional power source circuit.

A further object of this invention is to provide an alarm circuit wherein a conventional lamp, whether it is fluorescent or incandescent, may be provided with substantially full power during non-alarm conditions.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE DRAWING

FIG. 3 is a circuit of a further embodiment with connection points indicated to the embodiment of FIG. 1 and having power source and primary load failure detection alarm provision;

FIG. 4 is a partial schematic-block diagram of a radio alarm which may be used with, and has circuit connection points to, the embodiment of FIG. 3;

FIG. 7 is a schematic-block diagram of an embodiment of simplified design.

DESCRIPTION OF A PREFERRED EMBODIMENT

Figure 1:
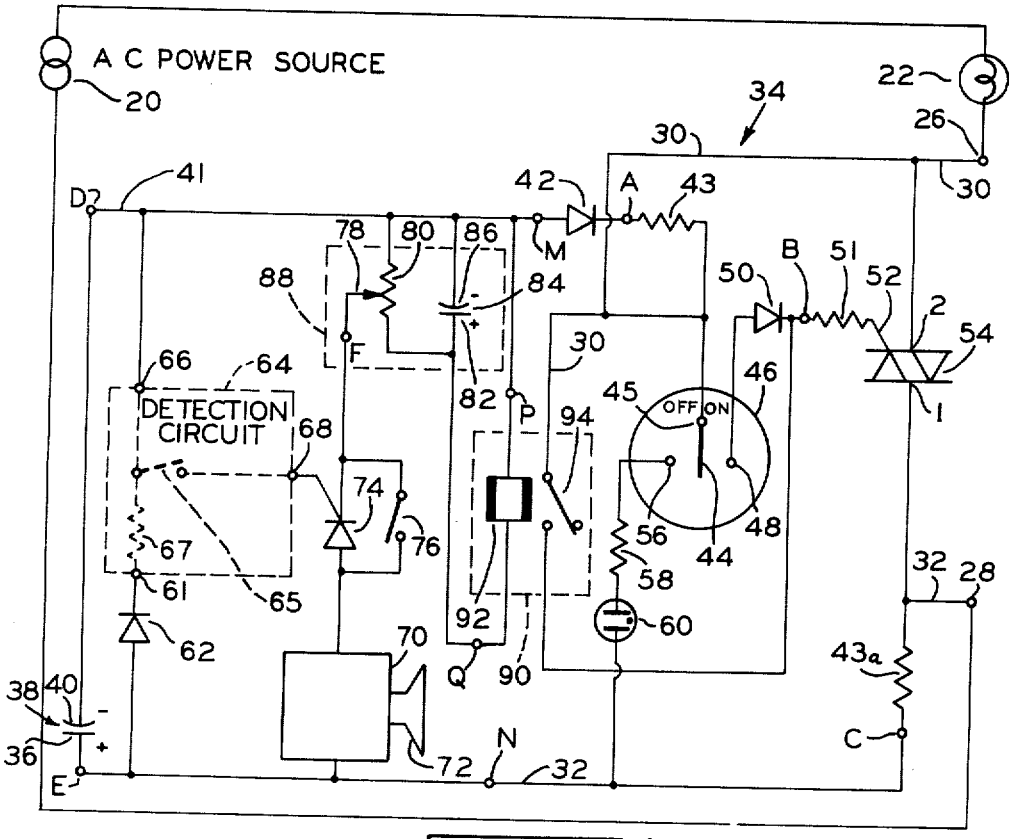
FIG. 1 PRIOR ART
FIG. 1 is a schematic-block diagram of an embodiment of the aforereferenced U.S. Pat. No. 4,093,943.

Referring to the drawing in FIG. 1 a circuit adapted for AC power supply operation is shown. A conventional household 120 volt 60 hz. power source 20 is shown in series connection with a conventional household lamp 22, the primary load. Lamp 22 is connected between terminal 26 and one side of source 20, with terminal 28 being connected to the other side of source 20. Terminals 26, 28 are located in a conventional switch box, not shown, and the conventional wall switch is removed. Lines 30, 32 of power distribution circuit 34 are connected respectively to terminals 26 and 28. It is seen that circuit 34 is series connected between terminals 26 and 28 and draws its power through load 22. Positive plate 36 of energy reserve capacitor 38 is connected to line 32 and negative plate 40 of capacitor 38 is connected to line 41 which is connected to the anode of a diode 42, which as will become apparent, isolates plate 40 from positive half cycles on line 30 from source 20. The cathode of diode 42 is connected to a terminal A. A resistance 43 is connected between terminal A and the switch blade 44 of a single pole double throw switch 46. A resistance **43*a* is placed in line 32 between a terminal C and terminal 28. Resistances 43 and 43*a* are selected to limit the current flow and power consumption of the circuit to a relatively low value such as 20 milliamps, and places line 41** at approximately 30 V.D.C.

Switch terminal 48 of switch 46 is connected to the anode of diode 50 which has its cathode connected through a terminal B and resistance 51 to gate 52 of a triac 54, which is a solid state switch which may be gated "on" with signals of positive or negative polarity. It is important that triac 54 is connected so that main electrode 2 of the triac is connected to line 30 and main electrode 1 is connected to line 32. When switch blade 44 is connected to terminal 48, a "dimmer" illumination of lamp 22 exists. One terminal of triac 54 is connected to line 30 and the other terminal is connected to line 32. Terminal 56 of switch 48 is connected to one terminal of resistance 58 which has its other terminal connected to one terminal of neon light 60 which has its other terminal connected to line 32.

A diode 62 has its anode connected to line 32 and its cathode connected to one terminal of a detection circuit 64 which has its other terminal connected to line 41. Diode 62 protects the circuit in the event of diode 42 failure. Circuit 64 may be any of suitable sensing circuits which can sense in one or more locations smoke, heat, intrusion, radiation, vibration, electrical circuit abnormality, or other sensed functions, and may be located remotely from circuit 34 in an area to be protected. A switch 65 is shown schematicaly which would close when a predetermined condition is sensed, but would otherwise be normally open. A signal is provided at terminal 68 of circuit 64 upon the sensing of a predetermined condition by circuit 64. Resistance 67 schematically depicts a load in circuit 64. Circuit 64 may also sense weather alert or civil defence alert signals to automatically energize the alarm and/or a radio which will broadcast to the house occupants the alert signal.

A secondary load 70, in this embodiment an audible alarm having a speaker 72, has one terminal connected to line 32 and a second terminal connected to the anode of an SCR (Silicon Controlled Rectifier) 74. The alarm 70 would be placed, in the usual circumstance, remotely from circuit 34 in an area or areas where it was desired an alarm would be given, or corrective action would automatically be taken, for the condition sensed by circuit 64. A manual reset switch 76 is connected across SCR 74 and is normally in the open position as shown.

The cathode of SCR 74 is connected to pointer 78 which is manually slidable along a resistance 80 having one terminal connected to line 41 and a second terminal connected to the positive plate 82 of capacitor 84. The negative plate 86 of capacitor 84 is connected to line 41. Resistance 80 and capacitor 84 are part of a timing circuit 88 which provides a time delay, adjustable by movement of pointer 78 along resistance 80. Relay 90 has a coil 92 with one terminal connected to line 41 and the other terminal connected to plate 82 of capacitor 84. Relay switch 94 is placed in close proximity to coil 92 and is closed upon a predetermined voltage such as 4 volts across coil 92 and opens when the voltage across coil 92 drops to a second predetermined level such as 2 volts. One terminal of switch 94 is connected to line 30 and pole 45 of switch 46, and the other terminal of switch 94 is connected through resistance 51 to gate 52 of triac 54. As will become apparent, relay 90 acts as a threshold device which closes only when a predetermined voltage is present. Other threshold devices such as a LED-phototransistor may be used in place of relay 90 to aid in determining the voltage threshold on capacitor 84 before discharge through coil 92.

In the operation of the embodiment shown in FIG. 1 of the drawing, assuming that AC power source 20 has gone through a full cycle of operation, plate 36 of capacitor 38 will be charged positively and plate 40 will be charged negatively. On a forward current half cycle, a positive voltage is applied to terminal 28 and line 32, and a negative voltage is applied to terminal 26 and line 30, causing diode 42 to conduct and a positive charge will be applied to plate 36 of capacitor 38 and a negative charge will be applied to plate 40. On a reverse current half cycle, with a negative voltage applied to terminal 28 and line 32, and a positive voltage applied to terminal 26 and line 30, diode 42 will not conduct and the aforementioned charge will be held on the plates of capacitor 38. On each forward current half cycle, capacitor 38 will be recharged to replenish any charge dissipation of capacitor 38 and diode 42 will prevent a discharge of capacitor 38 on a reverse current half cycle from source 20. Therefore, a positive voltage is applied to the anode of diode 62 and to the anode of SCR 74, through alarm 70, during both the forward and reverse current half cycles of source 20.

Assuming that circuit 64 detects a dangerous condition, such as smoke, heat, intrusion, or the like, switch 65 is closed completing a circuit between the cathode of diode 62 and line 41. Diode 62 will conduct placing a trigger voltage at terminal 68 and the gate of SCR 74 causing SCR 74 to fire. Alarm 70 will then be actuated since a circuit will be completed between line 32 and line 41 through SCR 74, pointer 78, and resistance 80. This alarm will be continuous since on a forward current half cycle, a positive voltage from terminal 28 through line 32 will flow through alarm 70, SCR 74, pointer 78, resistance 80 to the anode of diode 42 and to line 30 through light 22 to source 20. At the same time, a positive voltage will be applied to the anode of diode 62 causing it to conduct, maintaining a trigger voltage at output 68 and maintaining SCR 74 in conduction. On a reverse current half cycle, the positive charge from plate 36 of capacitor 38 will likewise maintain diode 62 and SCR 74 in conduction, although at a lower level.

During this "sensed" condition, plate 82 of capacitor 84 will become positively charged and plate 86 will become negatively charged with the period of charging being dependent upon the position of pointer 78 on resistance 80 and determines the alarm frequency of the circuit. When capacitor 84 has been charged to a voltage sufficient to energize coil 92, relay switch 94 closes. Once switch 94 has closed, a current path will be established between line 30 and gate 52 of triac 54 turning "on" triac 54 causing a full wave 120 volt signal between terminals 26 and 28 causing a corresponding full illumination of lamp 22 and shunting the remaining circuit 34 componentry, thus increasing the effective voltage across lamp 22. This will occur for both forward and reverse current half cycles of source 20 since either a plus or minus voltage on gate 52 will cause triac 54 to conduct. Thus, light 22 will alternate between full illumination and non-illumination, or between full illumination and the dimmer illumination if blade 44 is contacting terminal 48, during an alarm condition thus providing a visual alarm to the house occupants, or, depending on the number of and location of lamps 22, a visual alarm could be presented exteriorly of the premises providing a signal for help and flash the porch or post light as a locating beacon for fire, police, or other emergency aid. This invention, when used with a lamp post having a photocell control, overrides the photocell in daylight hours to provide an intermittent flashing of the post lamp at the alarm frequency. After plate 82 has sufficiently discharged through coil 92 and SCR 74, the voltage across coil 92 will fall below that required to hold in switch 94. Since AC triac 54 is conducting, allowing primary lamp 22 to light, the saturation voltage of the triac is approximately 1 volt or less. This voltage is impressed at point 26 and 28 effectively short circuiting coil 92, at the same time impressing nearly all the source voltage of 20 across lamp 22. Also, as the current flow through coil 92 decreases, it causes a counter EMF and coil current/voltage decay time is determined by resistance 80 and capacitor 84 discharge time. Switch 94 opens due to lack of coil voltage. Triac 54 turns off and points 26 and 28 are raised again to almost full line voltage of power source 20. Capacitor 84 now charges again to sufficient coil voltage to close switch 94 and sequential power distribution is accomplished. The period of alternation of lamp 22 illumination typically would be several seconds and is determined by the position of pointer 78 on resistance 80 and the threshold voltage at which switch 94 closes. Also, at the same time, an audible alarm from speaker 72 will be heard.

An important advantage of this circuit is its adaptability to a night light and dimmer switch capability with a minimum of added components. For night light operation, switch blade 44 of switch 46 is moved to terminal 56 thus connecting line 30 to resistance 58 and neon night light 60 completing a circuit with power source 20 through line 32. Light 60 and switch 46 may be located conveniently in the housing for circuit 34 or other desired locations. Light 60 will be illuminated continuously, when blade 44 is connected to terminal 56, but during an alarm condition, switch 94 and triac 54 shunt lamp 60 causing it to be extinguished. Alternatively, blade 44 may be switched to terminal 48 thus connecting line 30 to the anode of diode 50 and during positive voltage from source 20 to terminal 26, diode 50 will conduct applying a trigger voltage to gate 52 of triac 54 causing current flow through lamp 22. However, during negative voltage to terminal 26, diode 50 will be non-conductive and no trigger voltage will be applied to gate 52 and triac 54 will be non-conductive. Thus, lamp 22 will be intermittently illuminated at a 60 hz. frequency thus providing a phase-controlled dimmer for lamp 22. In this manner, lamp 22 is illuminated at a predetermined fraction of its rated power, thus greatly prolonging its life. Lamps have lasted eight to twenty times their normal life expectancy. As an example, if lamp 22 is rated at 100 watts, it may be illuminated at 50 watts during normal operation but will be intermittently illuminated at 100 watts during alarm. If desired, the period during which diode 50 is conductive, and thus the fraction of their rated power capacity may be adjusted by means well known to the art to provide an adjustable dimmer control. Another significant advantage is that in the event of an alarm condition, the alarm signal wili "override" the dimmer circuitry since when switch 94 is closed, and full voltage from line 30 bypasses diode 50 and is applied directly to gate 52 of triac 54 to illuminate lamp 22 at its full rated power capacity thus providing a brighter, intermittent lamp operation during alarm conditions.

After an alarm condition has subsided, SCR 74 will continue to conduct until reset switch 76 is momentarily closed which will discontinue conduction and discontinue alarm 70. The continued conduction until closure of switch 76 is a safety feature since once a dangerous condition has been sensed by sensor 64, a temporary cessation of that condition will not cause alarm 70 to stop. Also, switch 76 may be used to test the alarm circuitry by manual closing and this will simulate an alarm condition since the alarm circuitry will be closed as if SCR 74 were conducting.

Figure 2:
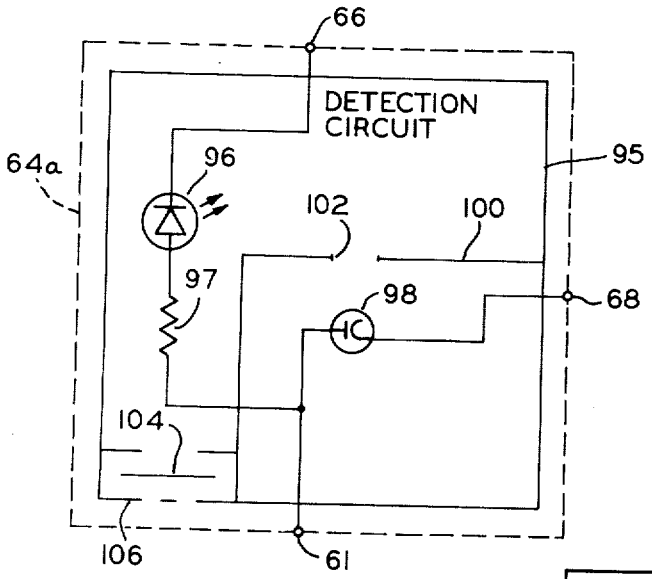
FIG. 2 is a diagram of a sensor usable in the embodiment of FIG. 1.

Referring to FIG. 2, a particular smoke sensor device is shown. Sensor device 64*a*, which may be substituted for sensor 64 in the circuit of FIG. 1, comprises a light-tight box 95 in which is mounted a light emitting diode 96 having its anode connected through resistance 97 to terminal 61 and its cathode connected to terminal 66. A photocell 98 is in close proximity to diode 96 and has its anode connected to terminal 61 and its cathode connected to terminal 68. A baffle housing 100 having opening 102 encloses photocell 98. Diode 96 will be illuminated by the current flow through diode 62 which is continuous in the embodiment of FIG. 2, and the illumination reflected from any ambient smoke will enter opening 102 to cause photocell 98 to decrease its resistance causing a trigger signal to appear at terminal 68. A baffle plate 104 is spaced from the walls of box 95 and perforated bottom 106 and will allow smoke to enter box 95 but will prevent light entrance. However, during absence of ambient smoke, the light transmissivity in the path between diode 96 and photocell 98 will be at a minimum and the resistance of photoconductor 98 will be correspondingly high preventing any current flow and preventing an alarm trigger signal at terminal 68 which will prevent SCR 74 from conduction. Also, sensor 64 may comprise a receiver which can be actuated by an emergency radio wave signal transmitted by a governmental or local commercial radio station to cause an alarm and at the same time automatically energize a speaker for broadcasting the emergency details. Also, if desired, circuit 34 may be formed in two modules which have conventional plug connections at terminals A, B, and C. The first module would have the high voltage components and the second module would have relatively low voltage components, thereby affording lower power rated wiring and components and protecting the user from high voltage shock. Resistances 43, 43*a*, and 51 provide voltage drops and lower voltages to the connection terminals A, B, and C.

Referring now to FIG. 3 circuitry is shown wherein an alarm is provided when either power source 20 or primary load 22 fails. The circuit shown in FIG. 3 is connected to that shown in FIG. 1 at terminals D, E, and F which are electrically coupled to corresponding terminals D, E, and F of the circuit in FIG. 1. In single pole double throw switch 110, a first terminal 112 is coupled to terminal F, a pole 114 is coupled to line 116, which is connected to terminal E. Switch 110 has a second terminal 118 connected to one terminal of alarm 120, which is preferably an audible alarm, the other terminal of which is connected to the collector of NPN transistor 122. A rechargeable battery 124 which is continuously charged from power source 20, has its positive terminal connected to line 116 and its negative terminal connected through resistance 126 to the anode of light emitting diode 128, the cathode of which is connected to line 130 which is coupled to terminal D. The emitter of transistor 122 is connected to terminal H. Voltage divider resistance 132 has one terminal connected to line 116 and the other terminal connected to the base of transistor 122. One terminal of voltage divider resistance 134 is connected to the base of transistor 122 and the other terminal is connected to line 130. Switch blade 115 of switch 110 is manually movable between terminal 118 and terminal 112.

In the operation of the embodiment of FIG. 3, assuming blade 115 is manually positioned to engage terminal 118, and assuming that source 20 and load 22 are in proper operating order, the potential between terminals D and E will be substantially that across capacitor 36 which has its negative plate connected to terminal D and its positive plate connected to terminal E. This will place a more negative potential on the base of transistor 122 relative the potential of the emitter of transistor 122 biasing transistor 122 "off". In this condition, transistor 122 is non-conducting and alarm 120 is off. However, if either source 20 or load 22 should fail, such as a power outage or a break in the filament of lamp 22, capacitor 36 will discharge through resistances 132, 134 and the potential on the base of transistor 122 will then be approximately that of the positive plate of battery 124 and the potential on the emitter of transistor 122 will be approximately that of the negative terminal of battery 124, causing transistor 122 to conduct and alarm 120 to sound, alerting the occupants that the source 20 or load 22 has failed. Alarm 120 will sound even though not receiving power from source 20 since battery 124 is in circuit with alarm 120 through line 116, switch 110, and transistor 122. The occupant thus is warned to either replace lamp 22 or have power source 20 repaired.

During normal operation of the circuit, when power source 20 and load 22 are operative, battery 124 is charged through line 116, resistor 126, diode 128, and line 130, causing diode 128 to illuminate indicating charging.

When switch blade 115 is manually positioned to contact terminal 112, power source 20 and filament 122 are tested and if both are in proper operating order, will cause intermittent, full level illumination of lamp 22, in similar manner to that when sensor 64 senses an alarm condition. This occurs since terminal 112 is coupled to terminal F which is at slide 78 of potentiometer 80, thus bypassing the sensor 64 circuitry and provides a completed circuit to timing logic circuit 88 to actuate relay 90 and load 22 as hereinbefore described. Also, in those instances where load 22 is located exteriorly of the premises, such as in a lamp post in the front yard of the building, by manually positioning blade 115 on terminal 112, lamp 22 may be caused to brilliantly flash thus serving as a locator for emergency vehicles such as fire, police, or ambulances in the event that these vehicles have been previously summoned for aid.

Referring now to FIG. 4, an embodiment is shown which is capable of receiving a radio broadcast signal of an emergency condition, such as a weather emergency or other broadcast emergency, and emitting an audible and visual signal of characteristic magnitude, pitch, and frequency to alert the occupants of such emergency condition. A ratio 140, commercially available, has a first terminal 142 connected to terminal H and a second terminal 144 connected to terminal G, which terminals are connected to corresponding terminals G, H as designated in the embodiment of FIG. 3, which places radio 140 across battery 124. Thus, battery 124 is available for powering the operation of radio 140 since terminals 142, 144 are coupled to the radio power supply. Radio 140 can be provided with a latching switch 146, which is automatically closed, and will remain closed until manual opening, upon the reception of an emergency radio broadcast, and may be a magnetic relay, solid state, or other commercially available switch for performing this function, is coupled between terminal 142 and the cathode of a light emitting diode 148, the anode of which is coupled through a sound alarm 150 to terminal G, or to the positive terminal of battery 124. Therefore, upon reception of an emergency signal, switch 146 will close causing diode 148 to become illuminated, providing a visual warning signal of the emergency signal, and causing audible alarm 150 to be energized, which may be an intermittent "beep" of characteristic magnitude, amplitude, and frequency, to alert the occupants of the particular emergency reception. The occupants may then tune to the emergency frequency on a radio receiver to obtain the emergency message.

Figure 5:
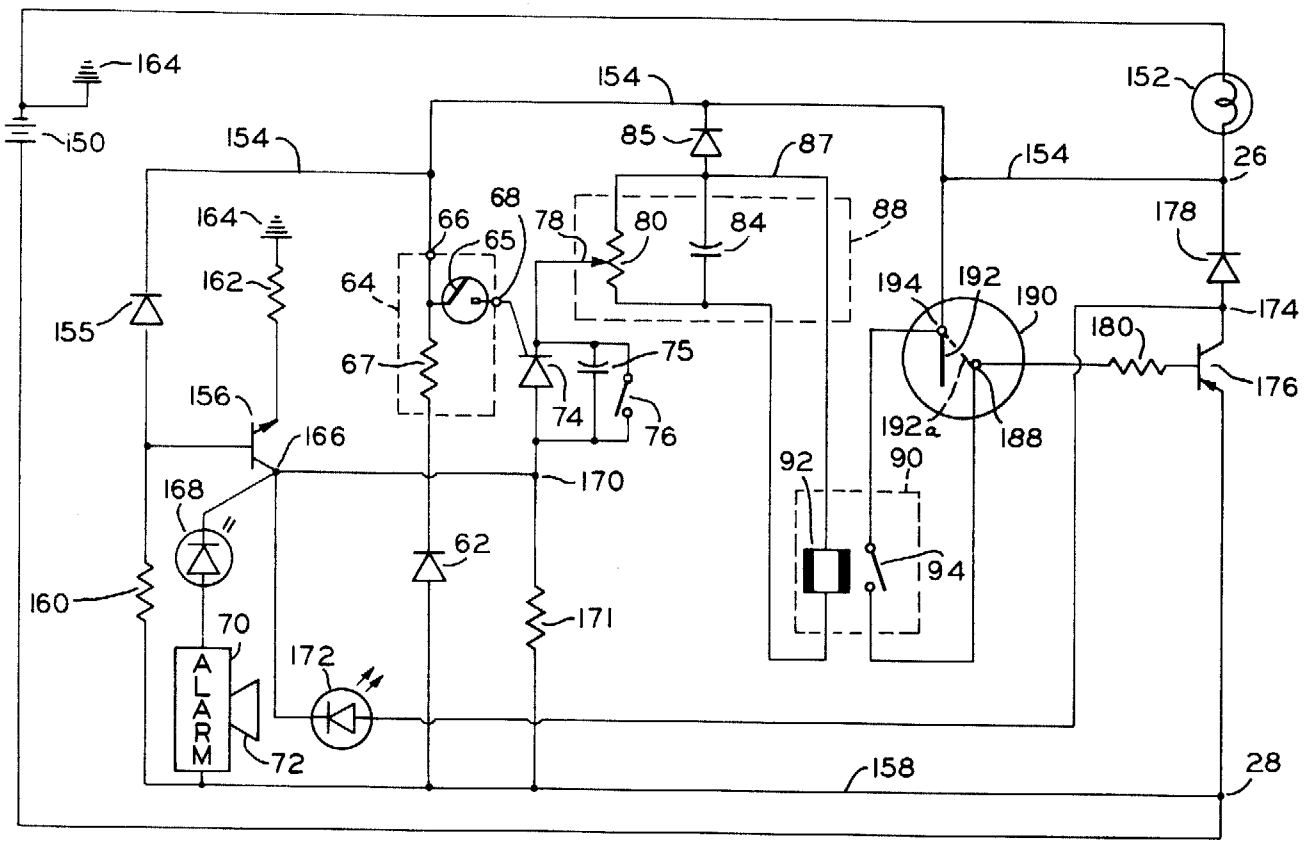
FIG. 5 is a schematic-block diagram of an embodiment which may be used with a unidirectional power source.

Referring now to FIG. 5, a further embodiment is shown wherein this invention is applied to a unidirectional power source or DC battery. The components common to those shown in FIG. 1 will carry the reference numerals and description of the FIG. 1 components. A 12 volt DC power source 150, such as is available in the conventional vehicle power source system, is shown in series connection with a lamp 152, such as a conventional vehicle lamp used for illumination or warning. Lamp 152 is connected between terminal 26 and the negative terminal of source 150, with terminal 28 being connected to the positive side of source 150. Terminals 26, 28 may be located in a conventional terminal box, not shown, in the vehicle control panel.

Line 154 is connected between terminal 26 and the cathode of diode 155, the anode of which is connected to the base of NPN transistor 156 and line 158 is connected between the terminal 28 and one terminal of biasing resistor 160, the other terminal of which is connected to the base of transistor 156. The emitter of transistor 156 is connected through resistance 162 to ground 164 and the collector of transistor 156 is connected to junctions 166, 170 and to the cathode of red LED (light emitting diode) 168 the anode of which is connected to one terminal of alarm 70, the other terminal of which is coupled to line 158. A resistor 171 is coupled between junction 170 and line 158. The cathode of green light emitting diode 172 is connected to junction 166 and the anode is connected to junction 174. Junction 174 is between the collector of PNP transistor 176 and the anode of diode 178, the cathode of which is connected to junction 26. The emitter of transistor 176 is coupled to junction 28 and the base of transistor 176 is coupled through resistance 180 to switch terminal 188 of switch 190. Blade 192 of switch 190 is manually movable from a first position, shown, to the dashed position **192*a* wherein it is in contact with terminal 188. The pole 194 of blade 192 is coupled to line 154 and to relay 90. A diode 85 has its cathode connected to line 154 and its anode coupled to line 87. A capacitor 75 is coupled across switch 76**.

In the operation of the embodiment of FIG. 5, when lamp 152 is in the "off" position, by virtue of switch blade 192 non contacting terminal 188, but lamp 152 is operable, that is is in a non-failure state, junction 26, line 154, and the base of transistor 156 are at approximately ground potential, biasing transistor 156 "off". When switch blade 192 is switched to position **192*a* in contact with terminal 188, the base of transistor 176 is coupled through resistance 180 to junction 26, biasing transistor 176 "on" causing lamp 152 to be illuminated. At this time, the potential at junction 26 rises to approximately +11.5 volts, and the potential at the base of transistor 156 also rises turning it "on", causing green LED 172 to become illuminated since its anode is connected to junction 174, which is at substantially +11.5 volts, and its cathode is coupled through transistor 156 and resistance 162 to ground 164. At this point in time, virtually no current is flowing through alarm 70 and red LED 168 since green LED 172** is connected in parallel therewith, and is of a much lower resistance, and therefore substantially all of the current is flowing therethrough.

However, when lamp 152 fails, such as a broken filament, a faulty or loose connection, lamp removal, or any other lamp failure condition, transistor 176 is "off" since its collector path to ground is broken. Also, green LED 172 ceases to conduct since its anode is no longer coupled to junction 28. However, alarm 70 and red LED 168 are coupled directly to junction 28 and since the parallel path through green LED 172 no longer draws substantially all of the current, alarm 70 and red LED 168 are energized through transistor 156, resistor 162 and ground 164, giving the automobile occupant an audible and visual alarm that lamp 152 has failed. Transistor 156 remains conducting since diode 155 is biased "off" and the base of transistor 156 is coupled to the positive pole of battery 150 through junction 28 and resistor 160. Therefore, when blade 192 is in position 192*a*, which is the "on" position for lamp 152, and when lamp 152 is in a non-failure state, green LED 172 is illuminated indicating to the vehicle operator that the lamp is in satisfactory operable state. However, when lamp 152 fails for any reason, green LED 172 is extinguished, and audible alarm 70 and visual alarm red LED 168 are energized alerting the operator to lamp failure.

The circuit of FIG. 5 also provides a smoke, or other alarm condition, sensed by detection circuit 64 when blade 192 is in the "off" position. When an alarm condition is sensed by circuit 64, switch 65 is closed in the manner previously described for the embodiment of FIG. 1, causing SCR 74 to conduct and logic timing circuit 88 to intermittently open and close switch 94, thus intermittently coupling terminal 26 to the base of transistor 176, thus causing transistor 176 to intermittently conduct, flashing lamp 152 and green LED 172. When green LED 172 is conducting, alarm 70 and red LED 168 are inoperative since substantially all of the current is flowing through the parallel path of green LED 172, but when LED 172 is non-conducting, alarm 70 and red LED 168 are energized since the parallel path is open as previously described. Thus, during a smoke or other condition sensed by detection circuit 64, both LED 172 and LED 168 and alarm 70 will intermittently be energized. Due to various circuit delays, LED's 168 and 172 will appear to flash together.

Figure 6:
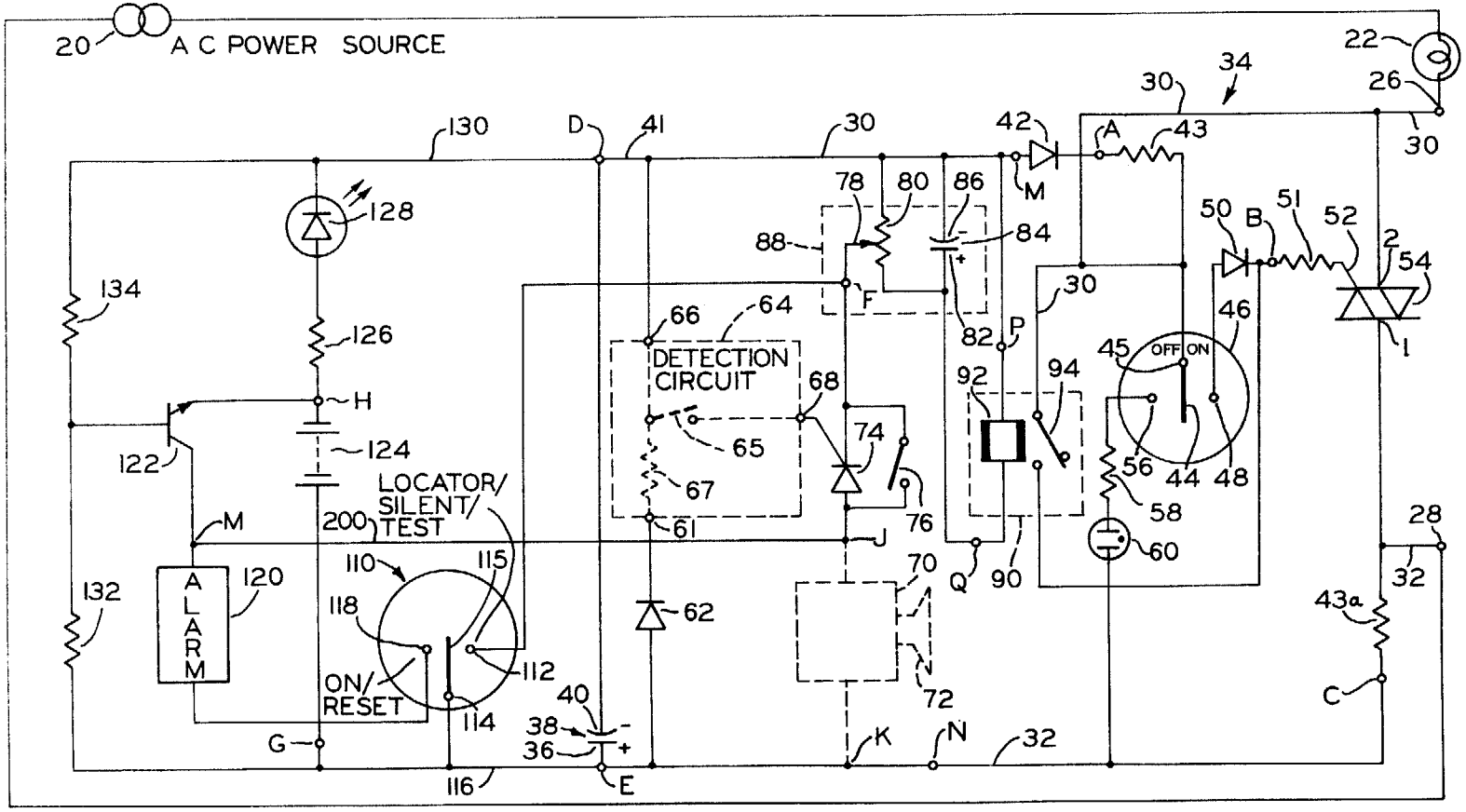
FIG. 6 is a modified schematic-block diagram wherein a power and load failure circuit utilizes a common alarm with the sensor circuit.

Referring now to FIG. 6, a further embodiment is shown. The circuit of FIG. 6 is similar to that of FIGS. 1 and 3 with the exception that alarm 70 and horn 72, are shown in dashed lines and a lead line 200 is connected between connection point J and connection point M, which is between the collector of transistor 122 and one terminal of alarm 120. In the circuit thus connected, and with alarm 70 and horn 72 and the leads therefrom to connection points J and K being deleted, alarm 120 will function for both the alarm when detection circuit 64 is activated by smoke, heat, or other emergency conditions for which it is designed, closing switch 65 therein, and will also function in the manner described for the circuit of FIG. 3 when power source 20 or primary load 22 fails. The components in FIG. 6 which have common reference numerals to those in FIGS. 1 and 3, are of the same component value, are similarly connected in the circuit, and operate in a similar manner.

In the operation of the circuit of FIG. 6 with alarm 70 and horn 72 being deleted therefrom, and assuming switch blade 115 of switch 110 is on contact 118, when an alarm condition is detected by circuit 64 and switch 65 is closed, SCR 74 is caused to fire and conduct, charging capacitor 84 through potentiometer 80 and periodic discharging through coil 92 and potentiometer 80, to intermittently close switch 94, and hereinbefore described for the circuit of FIG. 1. This will cause intermittent flashing at full voltage and brilliance of primary load 22, as hereinbefore described for the circuit of FIG. 1, and further will complete the circuit from lines 32, 116, through switch blade 115 of switch 110, contact 118 of switch 110, to one terminal of alarm 120, with the other terminal of alarm 120 being connected through line 200 to the anode of SCR 74, through SCR 74 to slide 78 of potentiometer 80 and to line 30, thus placing the voltage on capacitor 38 across alarm 120 causing alarm 120 to sound in an alarm condition. It is seen that the operation of sensor 64 will cause alarm 120 to sound whether or not transistor 122 is operative or connected in the circuit so that the operation of alarm 120 is not dependent on transistor 122 when circuit 64 has detected an alarm condition. When load 22 is operated at full voltage and full brilliance, the voltages on lines 30 and 32 are substantially the same, thus raising the potential at the base of transistor 122 since line 130 has now risen in potential from approximately −30 volts to approximately 0 volts, and the emitter of transistor 122 is tied to the negative terminal of battery 124. Thus, transistor 122 is biased to conduction, and since LED 128 is conducting both the battery 124 and the AC power source 20 are driving alarm 120, causing the alarm 120 to change tone intermittently due to the intermittent conduction of transistor 122.

In the operation in the circuit of FIG. 6 with alarm 70 and horn 72 electrically connected between connection points J and K, when detection circuit 64 senses an alarm condition, alarm 70 will be caused to operate intermittently, as described for the circuit of FIG. 1, and alarm 120 will be caused to operate intermittently, assuming the blade 115 is on contact 118, as described previously thus providing a dual alarm. Further, when there is a source 20 or primary load 22 failure, transistor 122 will be biased into conduction, as previously described for the circuit of FIG. 3, causing both alarms 70 and 120 to operate from battery 124. Alarm 70 has one terminal connected through connection point J and Transistor 122 to the negative pole of battery 124, and the other terminal of alarm 70 is connected through connection point K, lines 32 and 116 to the positive pole of battery 124. Alarm 120 will be actuated since it has one terminal connected through transistor 122 to the negative pole of battery 124 and the other terminal connected through contact 118 on switch 110, blade 115, and line 116 to the positive terminal of battery 124.

A relay coil may replace resistor 126 and when an alarm condition is sensed by circuit 64 or there is a failure of source 20 or load 22, the change in current flow through the coil will serve to operate an additional alarm circuit.

Referring now to FIG. 7, a circuit is shown which is simpler and more economical of manufacture. This circuit is for DC operation and applications similar to that for the circuit disclosed in FIG. 5. Similiar components carry similar reference numerals. Battery 150 has its positive pole connected through junction 207 to terminal 214 of switch 208, which is a single pole-single throw switch having switch blade 210 pivoted at pole 212 and switchable into and out of contact with terminal 214, with pole 212 coupled through junctions 216, 218 and primary load, or lamp, 205 to the negative pole of battery 150, which is also coupled to ground 164. A diode 155 has its cathode connected to junction 218 and its anode coupled to the base of NPN transistor 156 and through resistor 209 to junction 207. Red LED 168 has its cathode connected to the collector of transistor 156 and the cathode of green LED 172 and its anode coupled to one terminal of alarm 70, the other terminal of alarm 70 being coupled to junction 207. Coupled in parallel across alarm 70 and red LED 168 is green LED 172 which has its cathode connected to the collector of transistor 156 and its anode connected to junction 216.

Resistor 206 is connected between emitter of transistor 156 and ground 164.

In the operation of the circuit of FIG. 7, when switch 208 is closed, that is when blade 210 is in contact with terminal 214, lamp 205 becomes illuminated and when switch 208 is open, that is when blade 210 is moved to the position shown and is in non-contact with terminal 214, lamp 205 is deenergized. When switch 208 is closed, the potential at junction 218 is approximately +12 volts, since it is coupled directly through switch 208 to the positive pole of 12 volt battery 150, thus raising the potential at the base at transistor 156 turning transistor 156 "on" and causing green LED 172 to conduct since its anode is connected through switch 208 to the positive pole of battery 150 and its cathode is connected through transistor 156 and resistor 206 to ground 164. Thus, the vehicle operator has visual indication that lamp 205 is in a non-failure condition and operating. In this condition, red LED 168 and alarm 70 are not energized since they are shunted by a very low resistance of green LED 172 which carries substantially all of the current.

However, when lamp 205 is in a failure condition, and switch 208 is open, alarm 70 and red LED 168 will be energized indicating lamp failure, since the anode of red LED 168 is connected through alarm 170 to the positive pole of battery 150 and the cathode of red LED 168 is coupled to ground 164 through transistor 156 and resistor 206. Transistor 156 is biased "on" since diode 155 is biased "off" and the base of transistor 156 is raised in potential to approximately the potential at junction 207 and the positive pole of battery 150.

Figure 8:
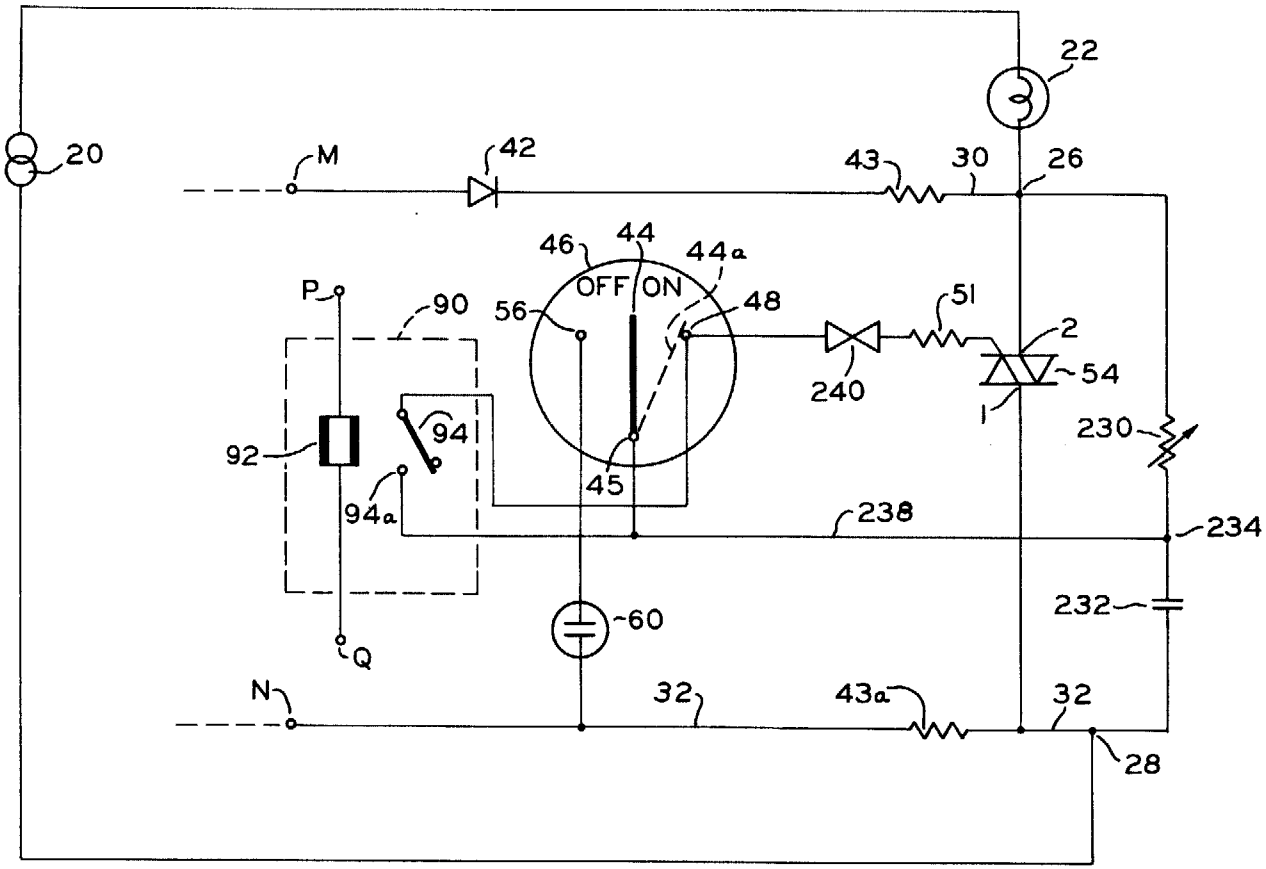
FIG. 8 is a partial schematic-block diagram for use with the embodiments of FIGS. 1 and 6 wherein the primary load may be provided in normal operation with substantially full power from the power source.

Referring to FIG. 8, a schematic-block diagram is shown which has connection points M, N, P, and Q which may be electrically coupled to connection points M, N, P and Q respectively in either diagrams of FIGS. 1 or 6. When so coupled, the circuit shown in FIG. 8 would replace that portion of each of the circuits in FIGS. 1 and 6 to the right of the connection points. The remainder of the circuits in FIGS. 1 and 6 would operate as previously described in conjunction with the circuit of FIG. 8 to be described hereinafter. Those components in the circuit of FIG. 8 which are similarly numbered to those components in the circuits of FIGS. 1 and 6 have the same component value.

In FIG. 8, a variable resistance 230 and capacitor 232 form a time constant circuit and one terminal of resistance 230 is coupled to one terminal of capacitor 232 at junction 234. The other terminal of resistance 230 is coupled to terminal 26, and the other terminal of capacitor 232 is connected to junction 28. Junction 234 is connected by line 238 to terminal **94*a* of relay 90 and to pole 45 of single pole double throw switch 46. Switch 46 has manually movable blade 44 which is shown in dashed position 44*a* in contact with terminal 48. Terminal 48 of switch 46 is coupled to one terminal of a bilateral threshold device 240 which conducts in either direction upon a predetermined voltage differential in either direction thereacross which differential may be 20–30 volts. The other terminal of device 240 is coupled to one terminal of resistance 51, the other terminal of which is coupled to the gate of triac 54. Triac 54 is connected as in the embodiments of FIGS. 1 and 6 having terminal no. 1 coupled to line 32 and terminal no. 2 coupled to one terminal of lamp 22, the other terminal of which is coupled to junction 236. Diode 42 has its anode coupled to connection point M and its cathode connected to one terminal of resistance 43, the other terminal of which is coupled to junction 26. Neon lamp 60 has one terminal coupled to terminal 56 of switch 46 and the other terminal coupled to line 32 between connection point N and one terminal of resistance 43*a*, the other terminal of which is coupled to junction 28**.

In the operation of the embodiment of FIG. 8, when blade 44 of switch 46 is manually moved to the "on" position **44*a* and contacts terminal 48, lamp 22 is energized from power source 20 during non-alarm conditions and is useful for room illumination. In this embodiment, as will become apparent, substantially full power from both halves of a cycle of the AC power source is applied to lamp 22 so that a fluorescent lamp having instant "on" capability may be used and an incandescent lamp will be operated at substantially full brillance. Also, since resistance 230 is variable, this provides a dimmer capability when lamp 22** is of the incandescent type.

Source 20 on a positive half cycle charges capacitor 232 with a very small current through resistance 230 and when the charge on the upper plate of the capacitor 232 reaches a predetermined minimum, a positive voltage is applied through line 238 and blade 44 to device 240, causing device 240 to conduct and providing a triggering voltage of the gate of triac 54 causing it to conduct; thus energizing lamp 22 during the positive half of the power cycle from source 20. The particular portion of the half cycle used will depend on the values of resistance 230 and capacitance 232, with the higher the time constant the lower the portion and with the lower the time constant, the higher the portion. By properly selecting the values of resistance 230 and capacitor 232, a time constant can be provided which utilizes substantially all of each half cycle.

During the second or negative half cycle, the upper plate of 232 is negatively charged and when it reaches a predetermined negative voltage, which is applied by way of line 238 and blade 44 to device 240 causing it to conduct, triggers triac 54 to energize lamp 22 from power source 20 in the manner previously described. Again, the portion of the negative half cycle from power source 20 that is used to energize lamp 22 depends on the time constant of resistance 230 and capacitor 232. The advantage of the circuit of FIG. 8 is that, by proper adjustment of the time constant, substantially full power may be applied to lamp 22 from source 20, so that fluorescent lights may be used as well as substantial full illumination of incandescent light, when switch 46 is in the "ON" position. When switch 46 is in the "OFF" position, voltage and current are maintained to the circuitry connected from FIGS. 1 and 6 to the connection points M and N, as previously described. Further, a very small current flows in lamp 22 during all periods so that the filament is kept warm, minimizing "cold filament" shock when full power is turned on.

In working embodiments the following values have been found to be satisfactory but are not to be construed as limiting of this invention.

| Reference Numeral | Component Value |
|---|---|
| | (Resistances) |
| 43 | 1.5 K ohms 2 watt |
| 43a | 1.5 K ohms 2 watt |
| 51 | 10 K ohms |
| 58 | 150 K $\phi$ watt |
| 80 | 5 K Potentiometer |
| 97, 126, 206 | 2 K ohms |

-continued

| Reference Numeral | Component Value |
|---|---|
| 132 | 16 K ohms |
| 134 | 12 K ohms |
| 67, 160 | 5 K ohms |
| 162 | 150 ohms |
| 180 | 1 K |
| 171 | 250 ohms |
| 209 | 200 K ohms |
| 230 | 30 K-250 K ohms |
| | (Capacitance) |
| 38 | 100 mfd. 50 volts |
| 84 | 100 mfd. 25 volts |
| 232 | .1 mfd. |
| | (Diodes) |
| 42 | IN 629 200 volts |
| 50 | IN 881 Low Leakage 200 volts |
| 62, 85, 155, 178 | IN 914 |
| Transformer in Alarm 70 - Calectro DI724 | |
| | (SCR) |
| 74 | GE 6 CU 25 volts 30-70 UA Gate |
| | (Relay) |
| 90 | Zestron 270-4-1A volts 500 ohms |
| | (Bilateral Device) |
| 240 | Radio Shack ER-900 |
| | (Neon Light) |
| 60 | NE2 |
| | (Triac) |
| 54 | ECG 5614 Sylvania 200-300 volts (or) SC240B GE 200-300 volts |
| | (Light Emitting Diode) |
| 96, 128, 148, 168 | Hewlett Packard 5082-4658 |
| 172 | Hewlett Packard 5082-green |
| | (Photocell) |
| 98 | Clairex CL904L |
| | (Alarm) |
| 120, 150 | Mallory Sonalert SC628 |
| | (Battery) |
| 124 | 9 volt Ni Cd Dynacharge Dynamic Instrument & Co. Houppage, N. Y. |
| | (Light Bulb) |
| 152 | 12 volt ESB |
| 205 | 12 volt sealed beam headlamp #6012 |
| | (Transistor) |
| 156 | Radio Shack RS2031 |
| | (Switch) |
| 46 | SPDT |
| 208 | Automotive dashboard headlamp switch SPST |

While there have been described above the principles of this invention in connection with specific apparatus, it is to be clearly understood that this description is made only by way of example and not as a limitation to the scope of the invention.

What is claimed is:

1. A power distribution circuit comprising; a power source; a primary load being coupled to and selectively energizable by said source;

an energy reserve having a predetermined reserve capacity;

first means for coupling said source to said reserve to provide said reserve with a flow of energy with the flow and accumulation of said flow being limited by said capacity when said load is not being energized;

second means for retaining said energy in said reserve when said load is being energized by said source;

a secondary load being coupled to the energy in said reserve;

third means coupled to said reserve for generating a signal upon the sensing of a predetermined condition;

fourth means coupled to said reserve and secondary load operable by said signal and said reserve for power coupling said secondary load to said power source upon generation of said signal; and fifth means coupled to said power source and primary load for providing an alarm when one of said power source and primary load become inoperative.

2. The apparatus of claim 1 wherein said fifth means comprises a transistor having a collector, emitter, and base;

a voltage divider being series connected with said primary load across said power source; said base being connected intermediately of said divider;

a battery;

an alarm;

said collector and emitter being series connected in switchably connectable relation with said battery and alarm; one of said battery terminals being coupled to said base whereby when either of said power source and primary load become inoperative and said emitter and collector are in switched connection with said battery and alarm, said transistor will be biased into conduction causing said alarm to be actuated.

3. The apparatus of claim 2 including a single pole, double throw switch; said switch in one throw position being series connected with said battery and alarm; said switch in a second throw position coupled to bypass said third means to operate said fourth means for power coupling said secondary load to said power source.

4. The apparatus of claim 1 including sixth means coupled to said fifth means for providing an alarm in response to a radio wave broadcast emergency signal.

5. The apparatus of claim 2 including a radio wave receiver being coupled across said battery and operable by said battery;

a second alarm; and switch means coupled to said receiver for coupling said alarm to said battery in response to a predetermined radio wave reception.

6. The apparatus of claim 5 wherein said second alarm comprises an audio and visual alarm.

7. The apparatus of claim 1 wherein said fifth means is for providing an alarm upon power source failure and upon primary load failure.

8. The apparatus of claim 1 where in said fifth means is for providing an alarm upon primary load failure.

9. A warning system comprising:

a power source having a given power capacity;

a primary load;

first means for detecting a warning condition;

second means coupled to said power source and said primary load for applying an operating level of said power capacity to said primary load to operate said load at a first operating level in the absence of a warning condition detection by said first means;

third means coupled to said primary load, said first means and said power source for applying a higher level of said power capacity than said operating level to said primary load upon detection by said first means of a warning condition to operate said load for warning purposes at a higher operating level than said first level; and fourth means coupled to said power source and primary load for providing an alarm when either of said power source and primary load become inoperative.

10. A power distribution system adaptable to replace an electrical switch in a circuit having an electrical power source and an illuminating load coupled in power receiving relation to said source and controllable through said switch, said load having a predetermined operating power capacity and decoupled from the power source by switch removal from said source comprising first means for providing an alarm circuit in switch replaceable relation to said load and in series with said load and power source wherein said alarm circuit receives operating power through said load; said first means having an alarm detection condition and a non-alarm detection condition; and second means coupled to said power source and illuminating load for providing an alarm when one of said power source and primary load become inoperative.

11. The apparatus of claim 10 wherein said second means includes a perceptible alarm that is actuated when either of said power source and primary load becomes inoperative;

alarm sensing means for sensing an alarm condition and coupled to said alarm for actuating said alarm when said alarm condition is sensed.

12. The apparatus of claim 11 including a unidirectional battery circuit coupled to said alarm for energizing said alarm when one of said power source and load become inoperative;

said electrical power source being bidirectional and circuit means for energizing said alarm from said bidirectional power source when said alarm condition is detected.

13. The apparatus of claim 12 wherein said alarm is energized by both said unidirectional power source and said bidirectional power source when said alarm condition is detected.

14. The apparatus of claim 10 wherein said second means is for providing an alarm upon power source failure and upon primary load failure.

15. The apparatus of claim 10 wherein said second means is for providing an alarm upon primary load failure.

16. A power distribution circuit comprising; a power source; a primary load being coupled to and selectively energizable by said source;

an energy reserve having a predetermined reserve capacity;

first means for coupling said source to said reserve to provide said reserve with a flow of energy with the flow and accumulation of said flow being limited by said capacity when said load is not being energized;

second means for retaining said energy in said reserve when said load is being energized by said source;

a secondary load being coupled to the energy in said reserve;

third means coupled to said power source and primary load for providing an alarm when either of said power source and primary load become inoperative.

17. The apparatus of claim 16 wherein said power source is bidirectional and third means comprises a unidirectional power source;

fourth means coupled to said reserve for generating a signal upon the sensing of a predetermined condition;

fifth means coupled to said reserve and secondary load operable by said signal and said reserve for power coupling said secondary load to said power source upon generation of said signal;

said secondary load comprising said alarm in said third means;

circuit means for energizing said alarm from said bidirectional and unidirectional power source when said predetermined condition is sensed.

* * * * *